US006422411B1

(12) United States Patent
Gray

(10) Patent No.: US 6,422,411 B1
(45) Date of Patent: Jul. 23, 2002

(54) TAMPER RESISTANT CLOSURE OVERCAP FOR METAL SPICE CAN

(75) Inventor: Alfred L. Gray, Belvidere, IL (US)

(73) Assignee: J. L. Clark, Inc., Rockford, IL (US)

( * ) Notice: Subject to any disclaimer, the term of this patent is extended or adjusted under 35 U.S.C. 154(b) by 0 days.

(21) Appl. No.: 09/350,847

(22) Filed: Jul. 9, 1999

(51) Int. Cl.[7] ..... B65D 17/28; B65D 43/16; B65D 51/18

(52) U.S. Cl. ..... 220/257; 220/214; 220/254; 220/259; 220/276; 220/826

(58) Field of Search ..... 220/254, 257, 220/259, 256, 253, 265, 270, 276, 266, 214, 826; 222/153.06, 153.07, 153.1, 541.5, 541.6, 541.9, 565

(56) References Cited

U.S. PATENT DOCUMENTS

| | | | |
|---|---|---|---|
| 779,339 | A | 1/1905 | Wulff |
| 2,521,098 | A | 9/1950 | Sebell |
| 3,155,285 | A | 11/1964 | Van Baarn |
| 3,251,509 | A | 5/1966 | Foster |
| 3,255,928 | A | 6/1966 | Foster |
| 3,370,757 | A | 2/1968 | Foster |
| 3,805,993 | A | 4/1974 | Enzie et al. |
| 4,024,976 | A | 5/1977 | Acton |
| 4,437,593 | A | 3/1984 | Bullock, III |
| 4,463,869 | A | 8/1984 | Lewis |
| 4,592,480 | A | 6/1986 | Hart et al. |
| 4,610,371 | A | 9/1986 | Karkiewicz |
| 4,621,744 | A | 11/1986 | Foster |
| 4,660,735 | A | 4/1987 | Peschardt et al. |
| 4,669,630 | A | 6/1987 | Kenyon |
| 4,682,706 | A | 7/1987 | DeVore et al. |
| 4,724,977 | A | 2/1988 | Cleevely et al. |
| 4,732,293 | A | 3/1988 | Landis |
| 4,759,465 | A | 7/1988 | Landis |
| 5,052,572 | A | 10/1991 | Pherigo |
| 5,219,087 | A | 6/1993 | Christensson |
| 5,273,176 | A | 12/1993 | Diaz |
| 5,617,968 | A | 4/1997 | Luburic |
| 5,626,251 | A | 5/1997 | Luburic et al. |
| 5,934,495 | A * | 8/1999 | Chiodo ..... 220/257 |

* cited by examiner

*Primary Examiner*—Lee Young
*Assistant Examiner*—Niki M. Eloshway
(74) *Attorney, Agent, or Firm*—Leydig, Voit & Mayer, LTD

(57) ABSTRACT

A tamper resistant closure overcap for a rectangular metal spice can covers each of the dispensing ports and openable flaps on the serving lid of the can. The closure has a top panel and a downward depending rectangular border that hugs the outer periphery of the serving lid. The closure is supported in spaced relationship with the serving lid to provide a gap for receiving promotional materials. The border includes a skirt and a tear away strip that can be fully or partially disconnected along a scored line of weakness to remove the closure. A support wall extends above the top panel to facilitate vertical stacking of multiple spice containers.

13 Claims, 5 Drawing Sheets

TAMPER RESISTANT CLOSURE OVERCAP FOR METAL SPICE CAN

FIELD OF THE INVENTION

The present invention generally relates to closures for containers and more particularly to tamper resistant closures for use with containers suited for food type items and other related products such as herbs, spices and the like.

BACKGROUND OF THE INVENTION

Tamper resistant packaging has been used in the food industry for several years for certain products such as milk, juice, and a wide variety of other types of items which have replaceable caps that screw or snap onto a container. However, most food product packages typically include no tamper resisting means and therefore are vulnerable to tampering. These are often inexpensive items in which the added expense of tamper resistant packaging may be thought to be cost ineffective or impractable.

One example where tamper resistant or tamper evidencing containers are not typically used is in the herb and spice industry. A common type of container for spices is a rectangular metal can having a rigid plastic server lid affixed to the open end of the can. The server lid includes dispensing ports covered by flaps which are typically hinged to the base of the lid. Typically, the lid has multiple flaps covering the various dispensing ports. The dispensing ports may be in the form of sift holes for sprinkling the spice, a pour hole for pouring spice out of the container or a spoon hole for spooning a measured amount out of the container, or any combination thereof. Other common types of spice containers include a plastic container with a plastic lid that is screwed or otherwise snapped onto the open end of the container. On these types of spice containers, it also is desirable to provide multiple flaps on the lid for exposing pour holes, spoon holes and sift holes. In the spice container art, there is little or no need to remove the serving lid from the container as the flaps provide the desired access to the product inside the container. As such, it common to have the serving lid permanently affixed to the container, particularly for metal spice cans.

There have been several tamper prevention designs for spice containers attempted to date such as Foster, U.S. Pat. Nos. 3,255,928, 4,361,250 and 3,251,501; and Hart, et al., U.S. Pat. No. 4,592,480. However, these designs require substantial redesign of the server lid or have certain practicality or cost drawbacks which is why these designs have not met with any or much commercial success.

A requirement for spice containers is that they are capable of being stacked for storage or display side by side and one on top of the other. Thus, the relationship between the container lid and the dimensions of the can are critical. Spice containers have a requirement of being easy to stack and capable of being stacked high without leaning and falling over when stacked in plurality. This requirement has also caused problems in tamper resistant enclosure designs for spice containers.

It has also been desired at various times to attach coupons, advertisements, short recipes or other promotional materials to the outside of the spice can for the purpose of inciting consumer interest in the product to prospective purchasers. Typically, these promotional items are plastic or paper items which are glued to the side or top of the can. However, such promotional items detract from the aesthetics and also can easily become detached from the spice container during transport or stacking on the shelves of a store. Promotional items may also interfere with spice container stacking, making the containers more susceptible to falling over. Moreover, for promotional materials such as coupons, the consumer is able to simply tear off the coupon for immediate use rather than waiting until the next purchase, which is undesirable.

SUMMARY OF THE INVENTION

It is therefore the general aim of the present invention to provide a practical and inexpensive tamper resistant closure for a spice container.

It is an objective of the present invention to provide a closure which completely covers the server lid including each of the openable flaps covering dispenser ports on the server lid of the spice container.

It is another object of the present invention to provide a closure element for a spice container which requires no or minimal changes to the existing server lids and containers existing out there in current use.

It is another objective of the present invention to provide a better way of attaching promotional materials to spice containers.

It is another objective of the present invention to accomplish above objectives while facilitating easy stacking of multiple spice containers one on top of another and side by side.

In accordance with these and other objectives, the present invention is directed at an improved tamper resistant closure overcap for a spice container which is typically used to hold a variety of different types of spices. The spice container for which the closure overcap is intended includes a canister and a serving lid attached to the open end of the canister. The serving lid includes multiple dispensing ports which are selectively covered by openable flaps. The closure overcap generally includes a top panel which is adapted to cover the entire top face of the serving lid thereby covering each of the openable flaps. A rectangular skirt depends downwardly from the top panel and is adapted to surround the outer periphery of the serving lid. A tear away strip depends downwardly from the skirt and is connected with the skirt along a line of weakness. A ridge projects inward from the tear away strip and is adapted to engage the lid to retain the closure on the serving lid. Thus, the tear away strip is the portion of the closure overcap which performs the retaining function by engaging the lid to hold the closure overcap on the lid. The closure overcap further includes a pull tab which can be pulled to fully or partially disconnect the tear away strip from the skirt along the line of weakness.

It is an aspect of the present invention that the spice container includes a rectangular metal can and a server lid which has openable flaps hinged through a thin web to the top plate which is connected to the open end of the metal can. No modifications are required for the server lid which allows old molding dies for the serving lids to continue to be used. An anchor groove may be formed or provided in the metal can just below the server lid to facilitate anchoring of the closure overcap to the spice container. An outward annular metal bead may also be formed in the metal can proximate the anchor groove such that the closure overcap lies flush with the metal can.

It is another aspect of the present invention that the top panel of the closure overcap may be provided in spaced relationship with the top face of the lid. This provides a gap therebetween which is sufficiently large enough to receive promotional materials such as coupons, recipes and the like. The closure overcap is preferably transparent to allow consumers to identify that promotional materials exist beneath the closure overcap.

It is another aspect of the present invention that a rectangular wall is provided rising above the top panel of the closure overcap which facilitates easy vertical stacking of multiple spice containers. In particular, the rectangular support wall is adapted to fit in the cavity beneath the metal can formed as a result of a bead or seam between the bottom panel and sidewall of the metal can.

Other objects and advantages of the invention will become more apparent from the following detailed description when taken in conjunction with the accompanying drawings.

Figure 1:
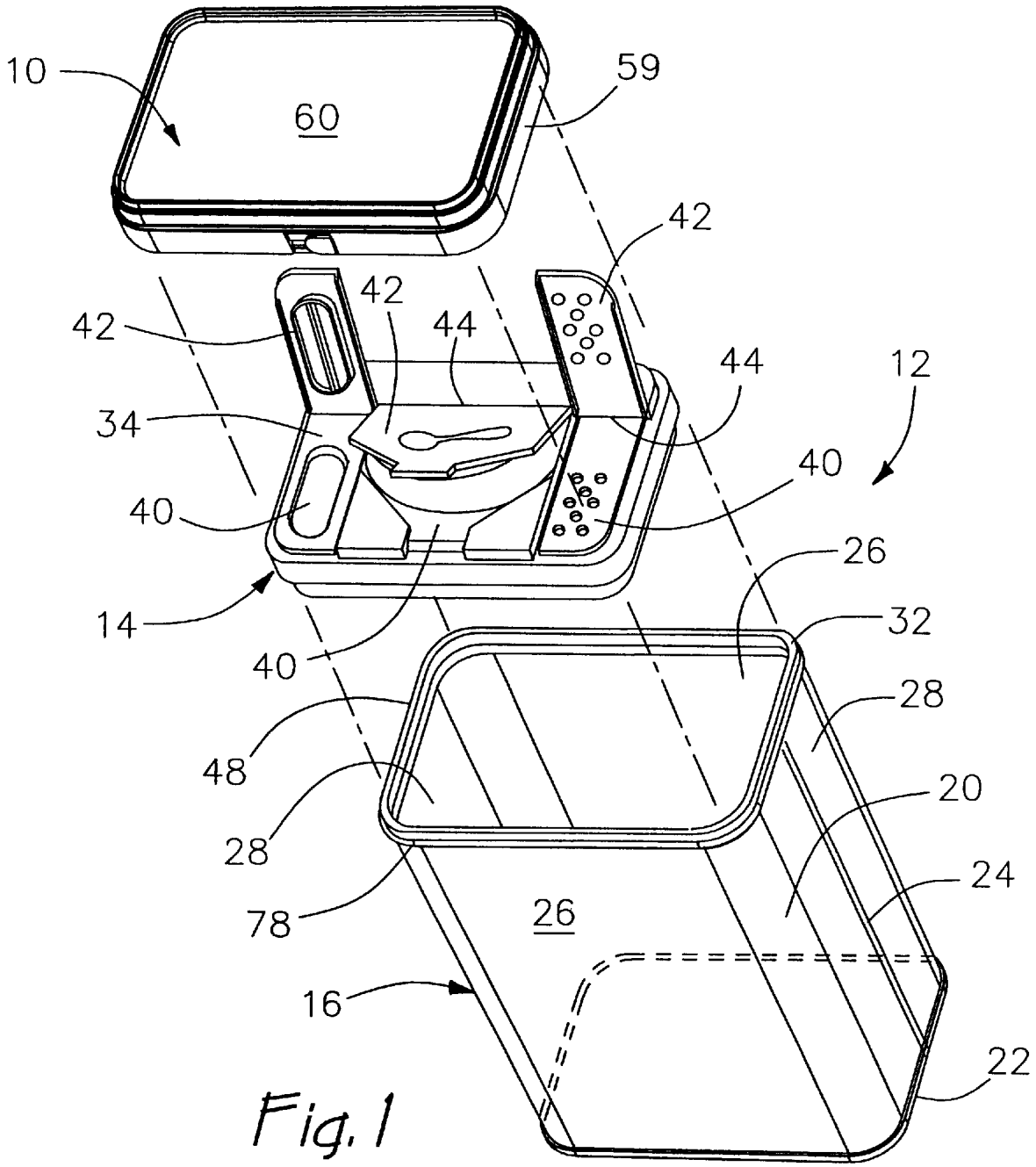
FIG. 1 is an exploded assembly view of a spice container including a closure overcap in accordance with a preferred embodiment of the present invention.
Figure 2:
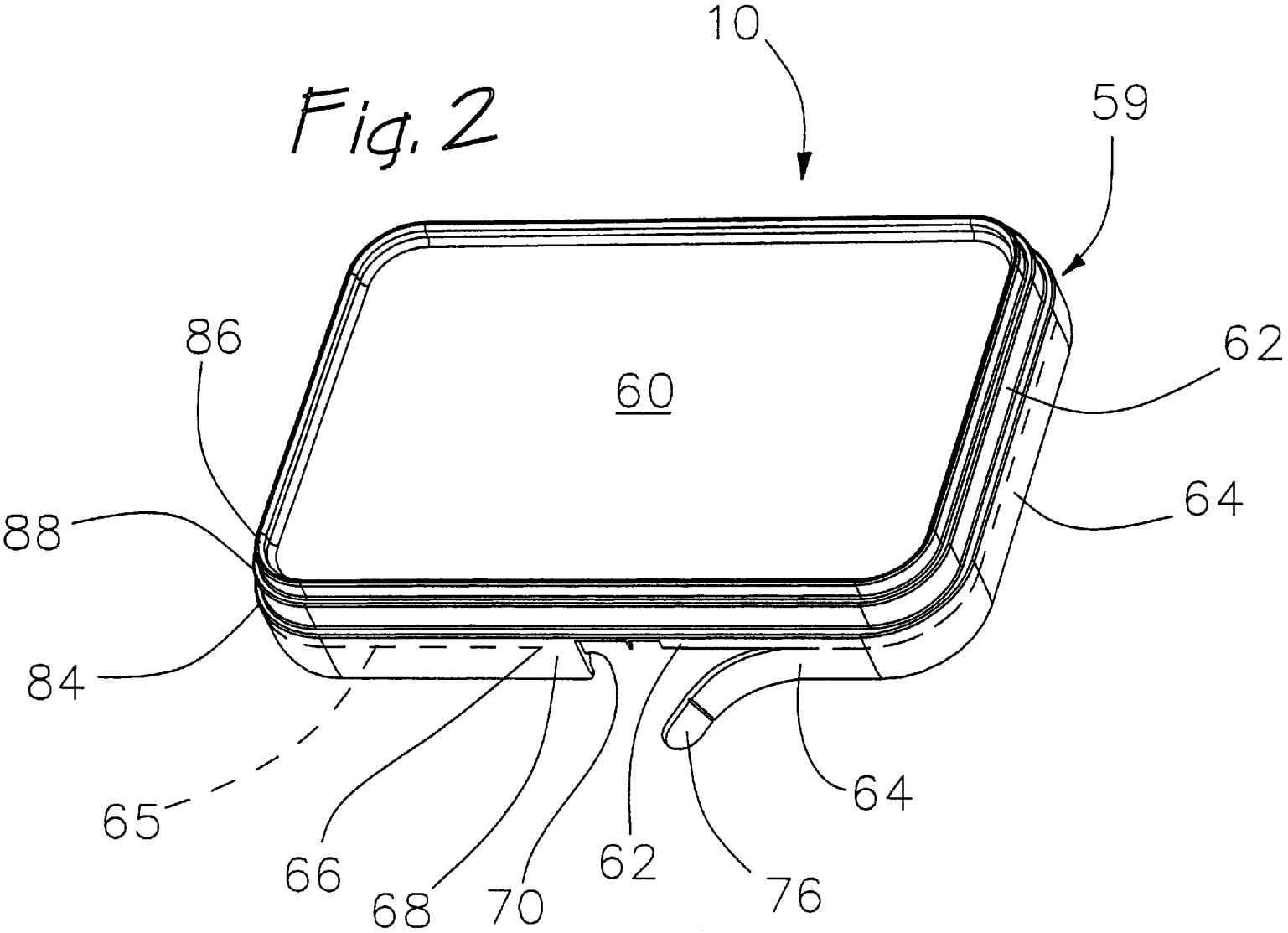
FIG. 2 is a perspective view of the closure overcap illustrated in FIG. 1.
Figure 5:
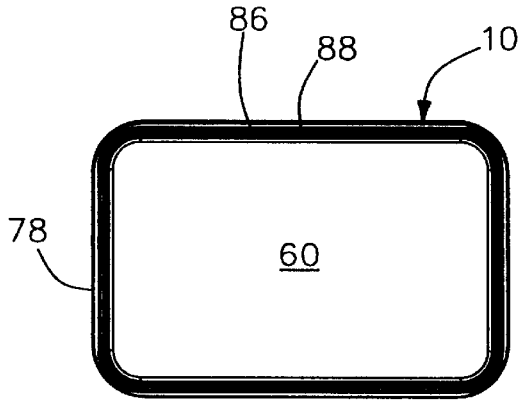
FIGS. 3–5 are side, end and top views of an assembled spice container using the components illustrated in FIG. 1.
Figure 3:
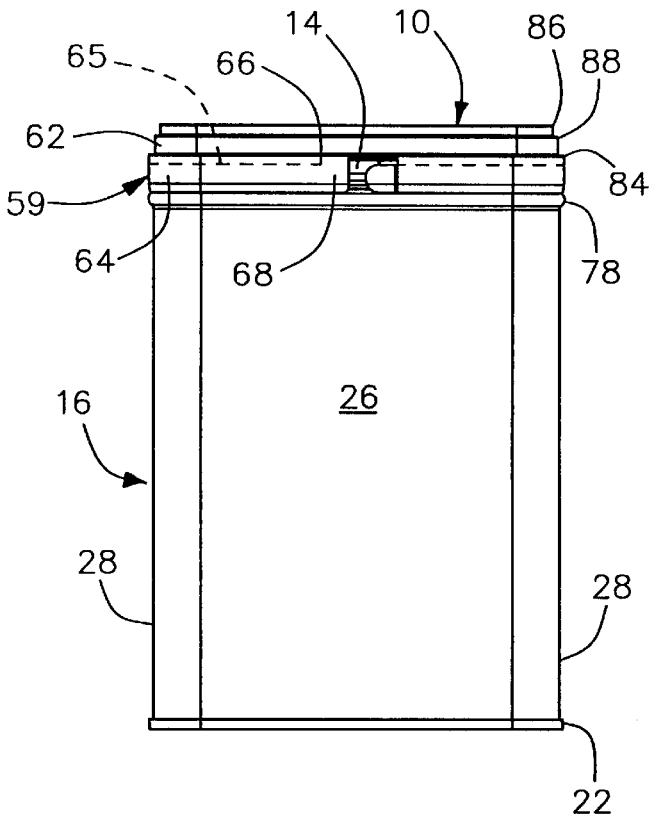
Figure 4:
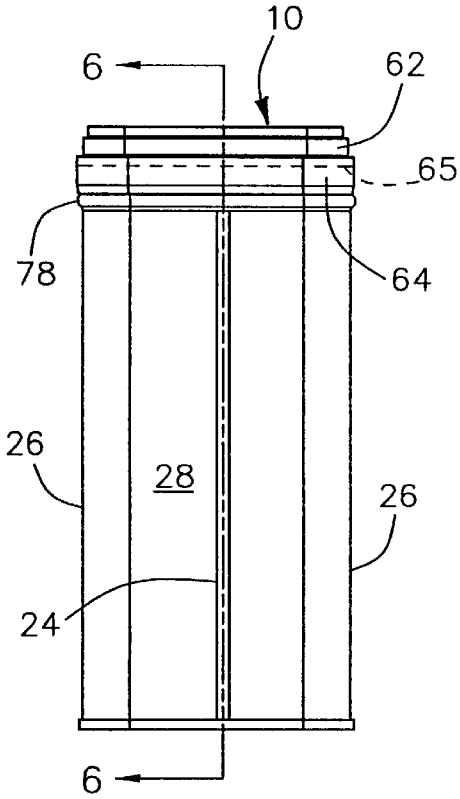

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

For purposes of illustration, a tamper resistant closure 10 and a spice container 12 incorporating the closure overcap 10 has been illustrated in the figures in accordance with a preferred embodiment of the present invention. The spice container 12 includes a conventional serving lid 14 that is adapted to close the open end of a metal can 16. The serving lid 14 by itself is conventional and maybe identical to those already existing in the prior art. The tamper resistant closure overcap 10 is secured over the serving lid 14 to prevent access to spices or other material in the can 16 through the serving lid 14 and to provide an enclosed space for holding promotional material.

Figure 6:
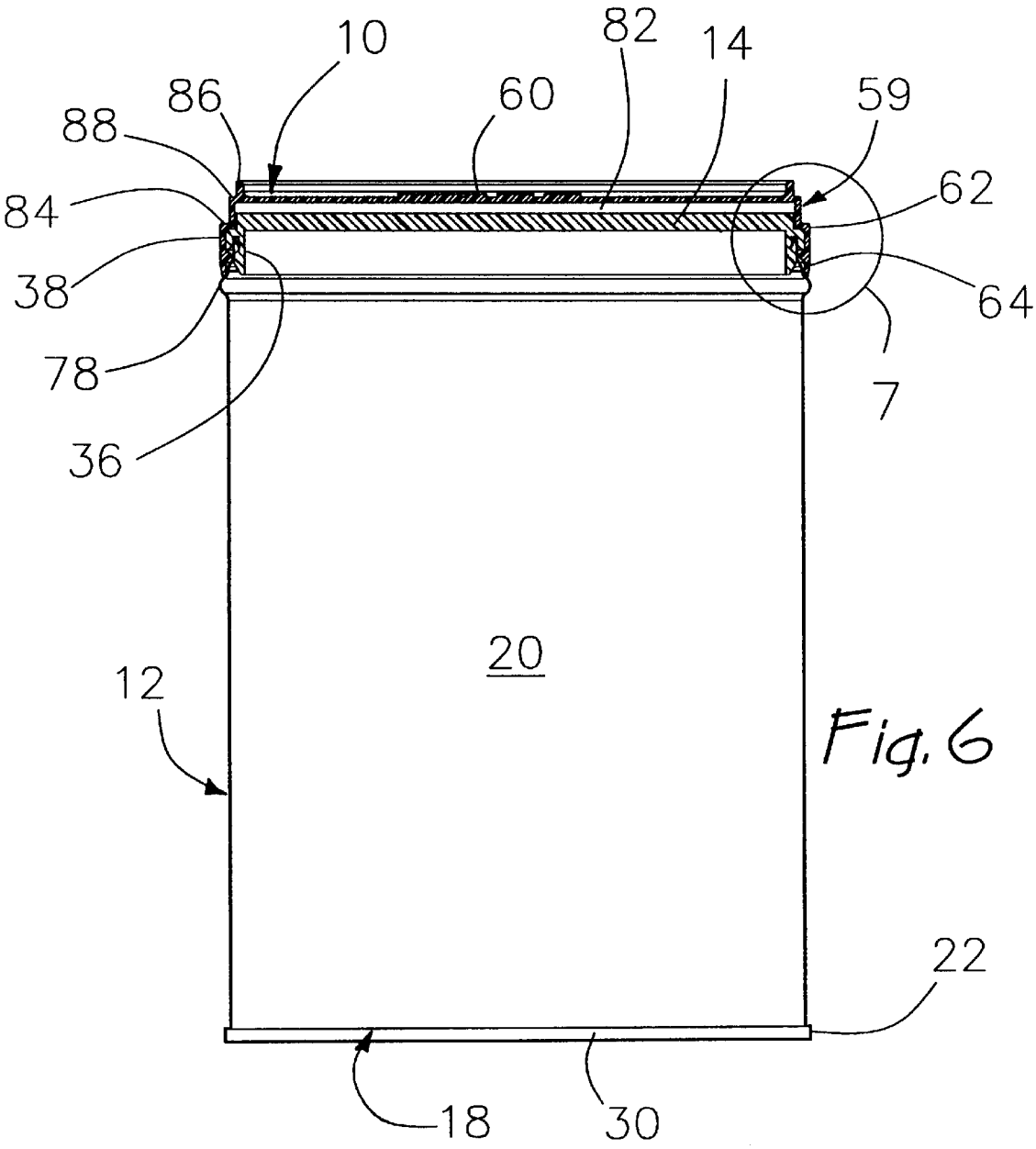
FIG. 6 is a cross-section of FIG. 4 taken about line 6—6.
Figure 7:
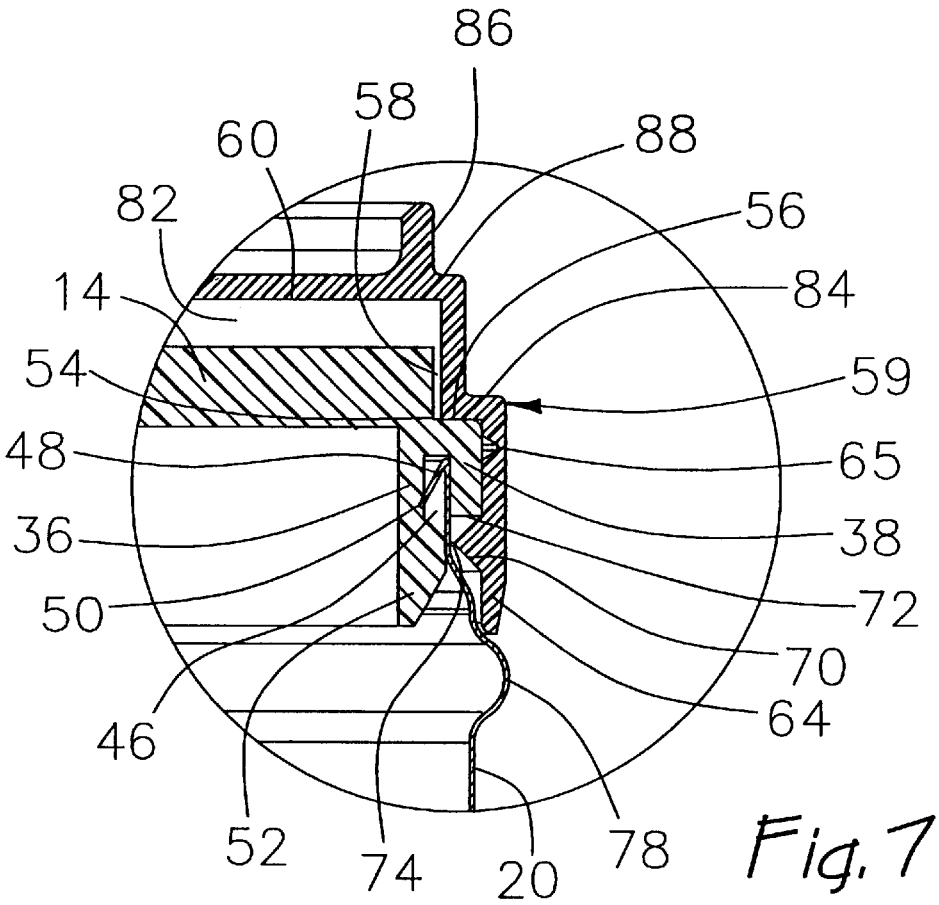
FIG. 7 is an enlarged fragmentary view of FIG. 6 taken about circle 7.

The metal spice can 16 includes a rectangular bottom panel 18 (FIG. 6) joined with a rectangular upright sidewall 20 at a crimped metal bead 22. The sidewall 20 is made from a single sheet of metal in which opposing edges of the sheet are seamed together at a longitudinal seam 24. The comers of the metal can 16 are generally annular or curved to prevent sharp projections but the nature of the metal can 16 is rectangular in that it includes pairs of generally parallel opposing sides 26, 28 in which each pair is mutually perpendicular. The metal bead 22 at the bottom end of the can 16 also provides a rectangular cavity 30 that has a sized relationship with the top surface contour of the serving lid 14 for stacking purposes. The sidewall 20 has an upper edge 32 that is adapted to engage and lock with the serving lid 14.

The serving lid 14 is made from relatively rigid plastic material and includes a top plate 34 with downwardly depending inner and outer flanges 36, 38. The top plate has a plurality of dispensing ports 40 for such things as pouring spice, spooning spice, or sifting spice. The serving lid 14 also includes openable flaps 42 which are hinged to the plate 34 over a thin web 44 of plastic material such that the flaps can be pivoted to open and close the container 12. The flaps 42 snap onto the plate 34 in a conventional manner to close the dispensing ports 40.

Between the inner and outer flanges 36, 38 there is provided a groove 46 which receives the upper edge 32 for locking the serving lid 14 to the metal can 16. The upper edge 32 of the can 16 is formed inward into a rectangular bead 48 whose terminating edge 50 engages an outward projecting lip 52 from the inner flange 36 to secure the serving lid 14 to the metal can 16.

The server lid 14 includes a corner 54 extending around the rectangular periphery of the serving lid 14 which includes an upright wall 58 and a flat seating surface 56 which is the top surface of the outer flange 38. The seating surface 56 is dimensioned to the rectangular metal bead 22 on the bottom of the metal can 16 such that multiple spice containers 12 can be stacked one on top of another in which the metal bead of the top container is seated onto the flat seating surface provided by the lid of a bottom spice container. The upright wall 58 prevents relative lateral movement of a metal spice container that is stacked on top of the lid.

In accordance with the aims and objectives of the present invention, the tamper resistant closure overcap 10 is secured over the serving lid 14 to cover each of the openable flaps 42. In this embodiment, the tamper resistant closure overcap 10 is made from relatively rigid injection molded plastic such as high or low density polyethylene, or other acceptable plastic. The closure overcap 10 includes a generally planar top panel 60 and a downwardly depending rectangular border 59 that generally surrounds the lid 14 and is anchored to the lid 14 to secure the closure overcap 10 to the container 12. The rectangular border 59 includes a rectangular skirt 62 projecting downwardly from the outer periphery of the top panel 60. The skirt 62 generally hugs the outer periphery of the surface of the serving lid 14. The border 59 also includes a tear away strip 64 depending downwardly from the skirt 62 and anchors the closure overcap 10 to the serving 14. The tear away strip 64 is connected to the skirt 62 along a scored line of weakness that extends at least partially around the rectangular periphery of the skirt 62. The end 66 of the tear away strip 64 is integrally connected with the skirt 62 along a strong portion 68 such that the tear away strip remains attached to the skirt 62 when the tear away strip 64 is removed to thereby provide easier disposal of the closure overcap 10.

The tear away strip 64 includes an inward projecting ridge 70 that engages the bottom edge 72 of the outer flange 38 of the serving lid 14 to secure the closure overcap 10 to the serving lid 14 and can 16. The outer flange 38 overhangs the upper edge 32 of the metal can 16 to form a groove generally indicated at 74 which receives the ridge 70. The inner peripheral tip of the ridge 70 may also contact the outer surface of the metal can 16. To facilitate easier removal of the tear away strip 64, a pull tab 76 is hinged to the leading end of the tear away strip 64 and preferably not connected in a way to the skirt 62 such that the tab may be moved outward for easy grasping between two fingers to facilitate easy removal of the tear away strip, and thereby allow the closure overcap 10 to be simply lifted off of the serving lid 14.

It is an aspect of the present invention, that the metal can 14 includes an outward projecting annular metal bead 78 in proximity to the upper edge 32 of the can sidewall 20 and just below the bottom edge of the tear away strip 64. The outer periphery of the metal bead 78 is dimensioned closely to that of the outer periphery of the tear away strip 64 such that the tear away strip 64 and the skirt 62 lie substantially flush with the outermost surface of the can 14. This helps prevent people from maneuvering a finger underneath the closure element to attempt to lift off the closure overcap 10 from the lid 14 without removing the tear away strip 64.

It is also an aspect of the present invention that the top panel 60 is disposed in spaced relationship with the top surface 80 of the serving lid 14 to thereby form a gap 82 for receiving promotional materials such as coupons, advertisements, recipes, and the like. The closure, and more specifically the skirt 62 includes a seat 84 seated on the ledge for which the metal bead 22 of the can is intended. The skirt 62 is longer than the upright wall 58 to maintain the desired space relationship between the top panel 60 and the top surface 80 of the lid 14, to thereby provide the desired size of gap 82 necessary for the desired promotional materials. The closure overcap 10 is preferably made from transparent material such that consumers at a store can readily see the promotional material stored inside the closure overcap 10. However, the material may also be semi-transparent, opaque or colored with logos and/or information on it. The closure overcap 10 can be engraved, embossed, debossed, labeled and the like if so desired.

It is another aspect of the present invention that the closure overcap 10 facilitates easy stacking of multiple spice containers 12 one on top of another. The closure overcap 10 includes an upwardly depending support wall 86 projecting upwardly from the top panel 60. The support wall 86 is disposed slightly inward from the outer perimeter of the top panel 60 such that a seating surface 88 surrounds the support wall 86. The seating surface 88 is also rectangular in nature and sized to receive the annular metal bead of a can stacked above the closure overcap 10. It should also be noted that spice cans can be stacked several on top of each other such that the closure overcap 10 is sufficiently rigid to support several containers while not collapsing the gap 82 if no promotional materials are inserted therein. The height of the support wall 86 is about equal to the depth of the cavity 30 for support purposes.

To obtain access to the contents within the container, the closure overcap 10 is removed by pulling the pull tab 76 to remove the tear away strip 64 along the scored line of weakness 65. After the tear away strip 64 has been completely detached from the skirt 62, the tear away strip 64 still technically remains attached to the skirt 62 by virtue of the strong portion 68 connecting the end 66 of the tear away strip 64 to the skirt 62. The closure overcap 10 can then be simply disposed of and serves no further purposes. At this point, promotional materials retained in the gap 82 are accessed by a consumer. By maintaining the promotional materials underneath the closure overcap 10, the promotional materials do not fall off during shipping and do not interfere with stacking of the spice containers. Once the closure overcap 10 is lifted off the serving lid 14, the flaps 42 can be opened as desired to expose the desired dispensing ports for pouring, spooning, shaking or other operation for getting the contents out of the can 16.

While a preferred embodiment has been shown as a plastic injection molded piece that snaps on the container, it will be appreciated that other types of plastics or materials may be used for the closure in alternative embodiments. It is currently envisioned that the material may be of the type which is rippable with or without a tear away strip such as plastic thermo-form material, PET (Poly-ethylene-terafate) or PVC (poly-vinyl-chloride) for example. It is also envisioned that the ridge may continuous or intermittent around the rectangular border of the lid depending upon how the ridge is formed. For example, the ridge may be formed by punching a plurality tangs or inward projections at various locations around the border and into the anchor groove after the closure is situated on the top of the container lid. The plastic material of the closure may be of the type that is subject to heat shrinking to better ensure a tighter fit on the container. These other envisioned embodiments would still preferably include the support wall on the top of the closure for stacking purposes and a gap for promotional materials if so desired.

Figure 8:
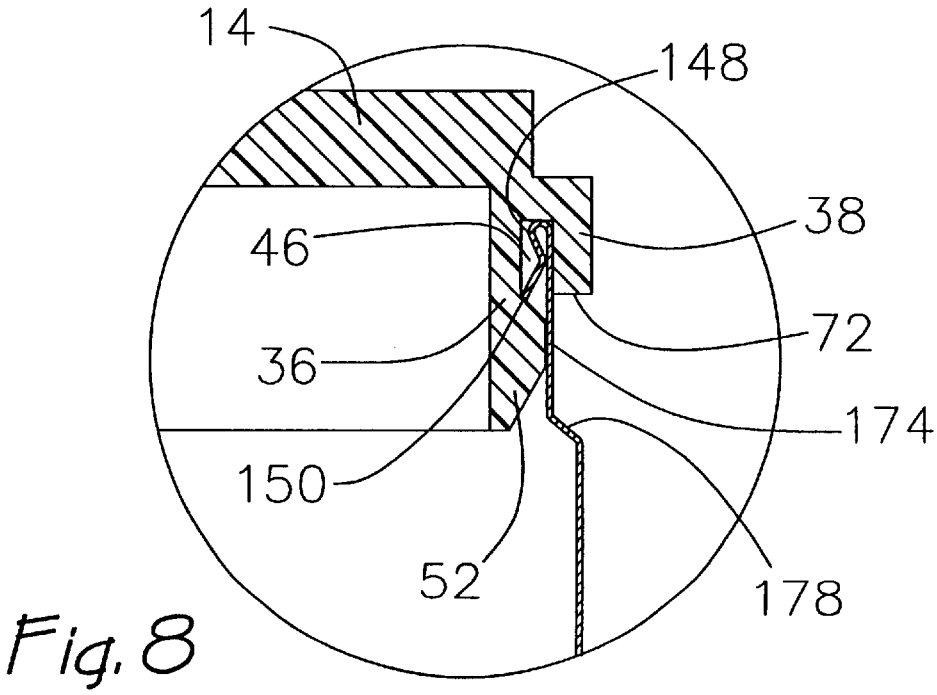
FIG. 8 is an alternative embodiment of a spice can for use with a closure overcap.

Referring to FIG. 8, an alternative embodiment of a spice container includes a slightly different type of can with the same serving lid 14 in which the anchor groove 174 is defined between the bottom edge 72 of the outer flange 38 and an inward projecting neck 178 spaced from the edge 72 to provide sufficient space for anchoring a closure element. The annular bead 148 is also formed differently with a rounded portion in the groove 46, but the terminating end 150 still engages the outward projecting lip 52 of the inner flange 36. It will also be noted that outward metal bead 78 has been eliminated in this embodiment.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A container, comprising:

a rectangular metal can including a rectangular bottom panel, a rectangular sidewall having one edge connected to the bottom panel by a metal bead, the bead surrounding a rectangular cavity, the sidewall extending upright from the bottom panel to a terminating beaded edge forming an open end;

a rectangular serving lid including a top plate having inner and outer rectangular flanges depending downwardly from the outer periphery of the plate, the flanges providing a rectangular groove therebetween receiving the beaded edge therein, the inner flange having an outward projecting lip beneath the beaded edge securing the beaded edge and the metal can to the serving lid, the top plate having dispensing ports covered by movable flaps integrally hinged to the top plate at thin webs;

an anchor groove extending around the can defined by the combination of the rectangular sidewall of the metal can and outer flange of the serving lid;

a tamper resistant closure overcap including a top panel enclosing each of the flaps of the serving lid, the top panel having a downwardly depending rectangular skirt surrounding the outer periphery of the server lid, the skirt have downwardly depending tear away strip connected along a scored line of weakness, the scored line of weakness extending at least partially around the rectangular periphery of the skirt, the tear away strip providing an inward peripheral ridge projecting into the anchor groove and engaging the bottom edge of the outer flange to retain the closure on the serving lid, the tear away strip integrally providing a pull tab adapted to be pulled to disconnect the tear away strip from the skirt along the line of weakness.

2. The container of claim 1 wherein skirt is supported by the serving lid to maintain a spaced relationship between the top panel and the top.

3. The container of claim 2 wherein the closure is transparent to view said promotional materials through the closure.

4. The container of claim 1 wherein the closure includes an upwardly depending rectangular support wall sized to fit in the cavity in contact with the inner surface of the rectangular bead.

5. The container of claim 1 wherein the closure comprises injection molded plastic, wherein the closure is snapped onto the serving lid.

6. The container of claim 1 wherein the metal can includes an annular bead projecting outward from the sidewall and extending around the side wall, the annular bead proximate the bottom edge of the tear away strip and having an outer periphery surface that is about equal to that of the tear away strip such that the tear away strip lies substantial flush with the annular bead.

7. The container of claim 1 wherein disconnecting the tear away strip completely releases the tamper resistant overcap from the serving lid for disposal.

8. A container, comprising:

a canister having a bottom wall and the sidewall extending upright from the bottom wall to a terminating edge forming an open end;

a serving lid including a top plate having an outer flange depending downwardly from the outer periphery of the top plate, the flange surrounding the open edge to enclose the open end, the top plate having dispensing ports adapted to be selectively covered by openable flaps; and a closure overcap including a top panel covering each of the flaps of the serving lid, a rectangular border depending downwardly from the top panel, generally surrounding the flange of the serving lid, and a ridge projecting inward from the inner periphery of the border, the ridge engaging the bottom edge of the outer flange to retain the closure on the serving lid.

9. The container of claim 8 wherein top panel has a spaced relationship with the top plate to form a gap therebetween sufficient for receiving promotional materials.

10. The container of claim 9 wherein the closure is transparent to view promotional materials through the closure.

11. The container of claim 8 wherein the closure overcap includes a tear away strip adapted to be disconnected from the rest of the closure overcap along a line of weakness.

12. The container of claim 11 wherein disconnecting the tear away strip completely releases the tamper resistant overcap from the serving lid for disposal.

13. The container of claim 8 wherein the closure overcap includes an support wall rising above the top panel adapted to support a bottom surface of the canister of another container.

* * * * *